US006260732B1

(12) United States Patent
Khodush

(10) Patent No.: US 6,260,732 B1
(45) Date of Patent: Jul. 17, 2001

(54) CARTON HANDLE

(76) Inventor: Alexander Khodush, 4604 Nesbitt Ct., Raleigh, NC (US) 27616

( * ) Notice: Subject to any disclaimer, the term of this patent is extended or adjusted under 35 U.S.C. 154(b) by 0 days.

(21) Appl. No.: 09/505,311

(22) Filed: Feb. 16, 2000

(51) Int. Cl.[7] ..... B65D 7/00
(52) U.S. Cl. ..... 220/737; 220/757; 220/758
(58) Field of Search ..... 220/737, 757, 220/758, 720, 759

(56) References Cited

U.S. PATENT DOCUMENTS 2,275,875 * 3/1942 Werfel ..... 220/758 X
2,361,417 * 10/1944 Reichart ..... 220/758 X
2,378,867 * 6/1945 Reichart ..... 220/758 X
2,638,245 * 5/1953 Loesel ..... 220/737 X
2,843,302 * 7/1958 Bandy ..... 220/737
4,685,583 * 8/1987 Noon ..... 220/737 X
4,874,109 * 10/1989 Cook ..... 220/737 X

* cited by examiner

*Primary Examiner*—Steven Pollard
(74) *Attorney, Agent, or Firm*—Mills Law Firm PLLC

(57) ABSTRACT

This invention is a handle for liquid food cartons. It can be used without regard to the carton opening by separating the top portion thereof or has a spout with a screw cap. The carton handle includes a bail that slides down over the carton and is then tightened down with the flip of a toggle by the thumb of the user. There is a safety stop that prevents the toggle from inadvertently being released. When it is desired to have the bail released or loosened around the carton, the toggle is flipped toward the carton and the bail simply slidingly removed therefrom.

7 Claims, 4 Drawing Sheets

CARTON HANDLE

BACKGROUND OF INVENTION

1. Field of the Invention

This invention relates to handles and more particularly to handles for food cartons, such as milk cartons, juice cartons and the like.

Cartons for liquid such as milk, juice and the like are well known to the consuming public. Many of these cartons have fold out spouts that are tucked back in their original position when not pouring fluids therefrom. Other cartons of the same general type have spouts in the sloped upper portion with a screw on cap.

Water weighs approximately eight pounds per gallon. Liquid foods such as milk and juices that contain a high percentage of water weight approximately four pounds per half gallon carton. This is not a great weight for healthy adults but can be a two-handed struggle for children and the elderly and the infirm. Picking up and pouring a half gallon carton which is approximately four inches wide can be difficult to grasp and pouringly manipulate at the same time, particularly in high humidity conditions where the sides of the carton can be damp causing it to be even more difficult to grasp.

To overcome the above indicated problems and to have an easy to grasp handle rather than having to grasp the width of the carton, various plastic and metal means and contraptions have been developed. These various prior art carton handles in many instances are difficult and time consuming to install and remove, many of them can be used on fold-out spout cartons, but not on the cap spout cartons. Other carton handles simply do not grasp the carton in a positive manner thus tending to shift up and down as the carton is being used.

2. Description of Prior Art

U.S. Pat. Design No. 286,509 to Michael R. Havis discloses a container holder that is generally triangular shaped in cross-section.

U.S. Pat. No. 679,742 to Wilfred H. Goddard discloses a detachable can holder that is made from wire with a slide that grips the neck.

U.S. Pat. No. 1,038,116 to Peter Grabler is a handle for receptacles and is made of wire which holds a bottle.

U.S. Pat. No. 1,789,876 to William a. Molyneux is a handle like device for utensils that is used pick up a pie tin.

U.S. Pat. No. 2,763,414 to Fred D. Young and Thomas W. Munger is a handle for milk cartons that is made of wire with a slide thereon.

U.S. Pat. No. 3,056,622 to Edmund Peter Hilderbrandt and Siegfried H. Fahnrich, Clinton and William E. Dylewicz, assignors to Fun Time Plastics, Inc. of Leominster, Massachusetts is a milk carton carrier and pouring handle that slides up under the top of the carton and has arms that go around the same.

U.S. Pat. No. 4,669,627 to Ueda Kazuo, assignee: Shikoku Kakooki Co., Ltd., of Tokushima, Japan discloses a sealed container for cartons that has to be assembled about.

U.S. Pat. No. 4,889,376 to Thomas Nagy discloses a box holder with handle that is formed in one piece that snaps over a carton.

U.S. Pat. No. 4,072,964 to Frank A. Escalante discloses a plastic bottle holder that is formed in one piece wherein the bottle slips into the holder for easy pouring.

Finally, U.S. Pat. No. 5,645,196 to Charles 0. Hancuff discloses a liquid drink carton holder wherein the carton is inserted thereinto.

BRIEF DESCRIPTION OF INVENTION

After much research and study into the above mentioned problems, the present invention has been developed to provide a simple, easy on, easy off sliding motion that, with the flip of a toggle by the thumb of the user, can be tightened down to grip the carton in a positive manner. There is a safety stop that prevents the toggle from inadvertently being disengaged, but when it is desired to release the same, this can be done with a flip of the toggle to release the tight grip on the carton for easy removal therefrom.

DETAILED DESCRIPTION OF INVENTION

Figure 1:
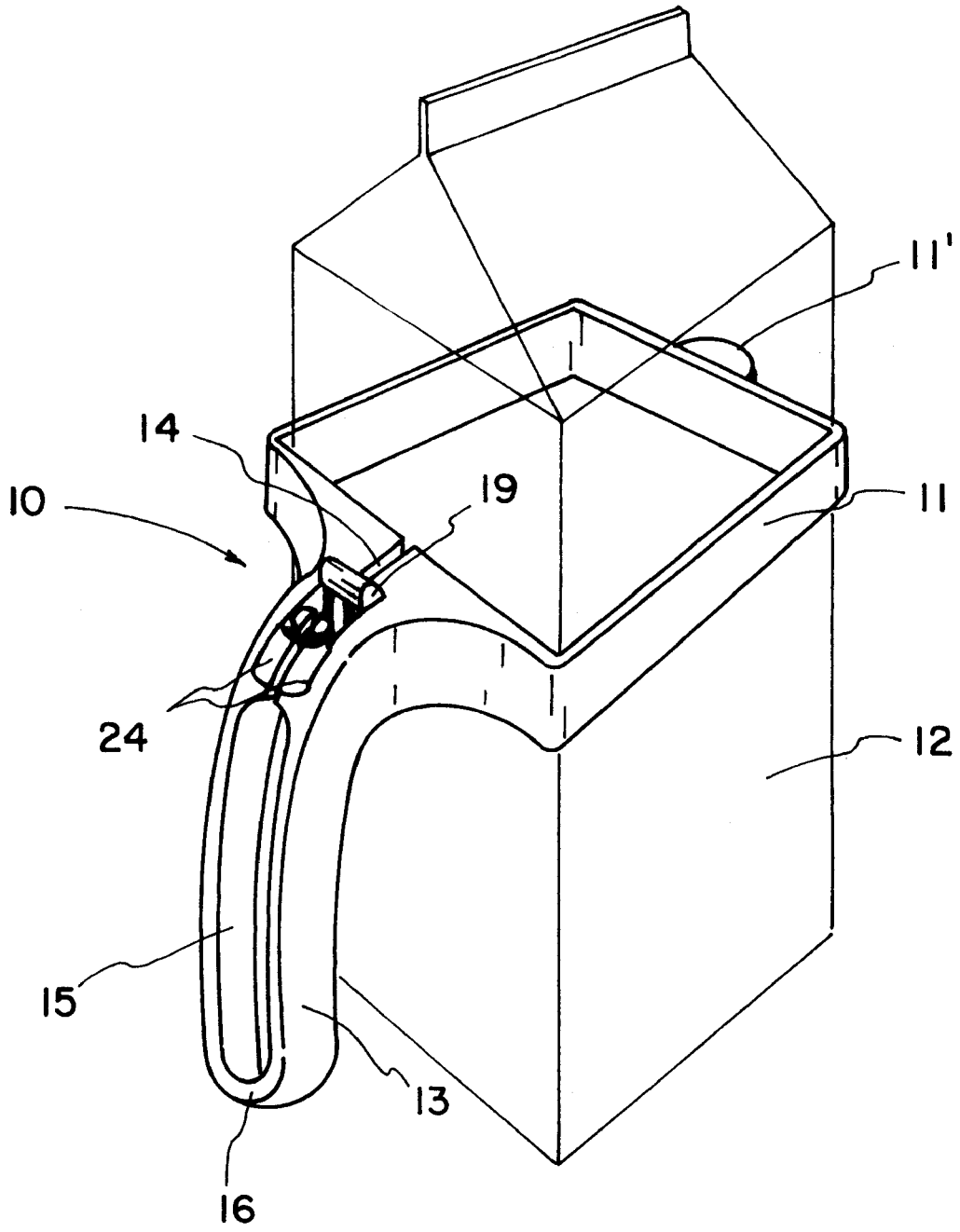
FIG. 1 is a perspective view of the handle of the present invention in the open or unlocked position disposed on a carton.

The carton handle of the present invention, indicated generally at 10, includes a bail portion 11 that is so sized to encircle a carton 12. The carton handle 10 is split as indicated at 14 from the area adjacent the carton to the hollow opening 15 in such handle. An outwardly projecting lip 11' is provided to help in installing and removing bail 11.

Figure 5:
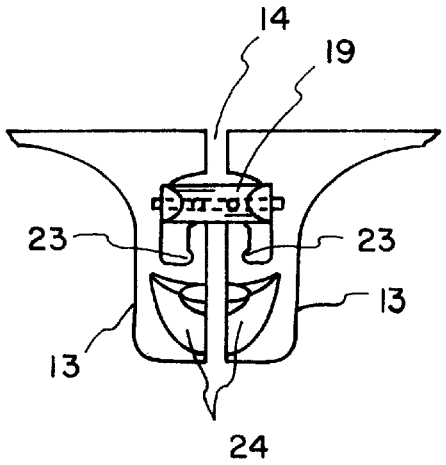
FIG. 5 is a top plan view with the toggle in the unlocked or open position so the handle can be manipulated relative to the carton.
Figure 6:
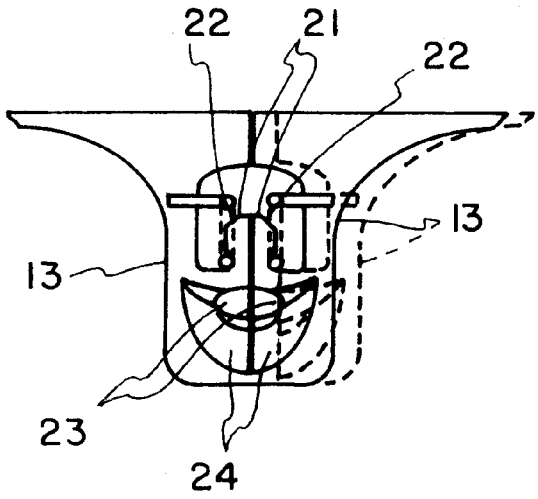
FIG. 6 is a cutaway top plan view showing the carton handle in the locked position and the open position.
Figure 7:
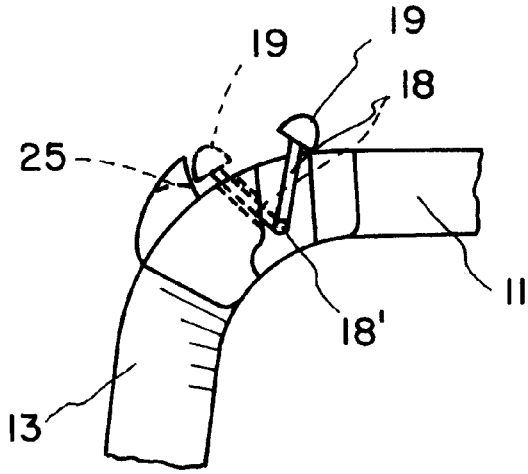
FIG. 7 is a side elevational view showing the movement of the toggle mechanism as well as the toggle guard to prevent accidentally releasing of the toggle.

The lower portion 16 of the handle 13 is one piece and is so formed to bias the spit opening 14 normally open as shown in FIGS. 1 and 5 so that the bail portion 11 of the handle can be easily slipped over the carton 12.

Openings 17 are formed in the interior walls of slot 14 and are adapted to receive the outwardly projecting ends of L-shaped toggle arms 8 of toggle 19.

A toggle opening 20 has a bulbous portion 21 projecting there into. This bulbous portion is split as is the upper portion of the handle 13 and includes beveled surfaces 22 and notches 23.

Figure 2:
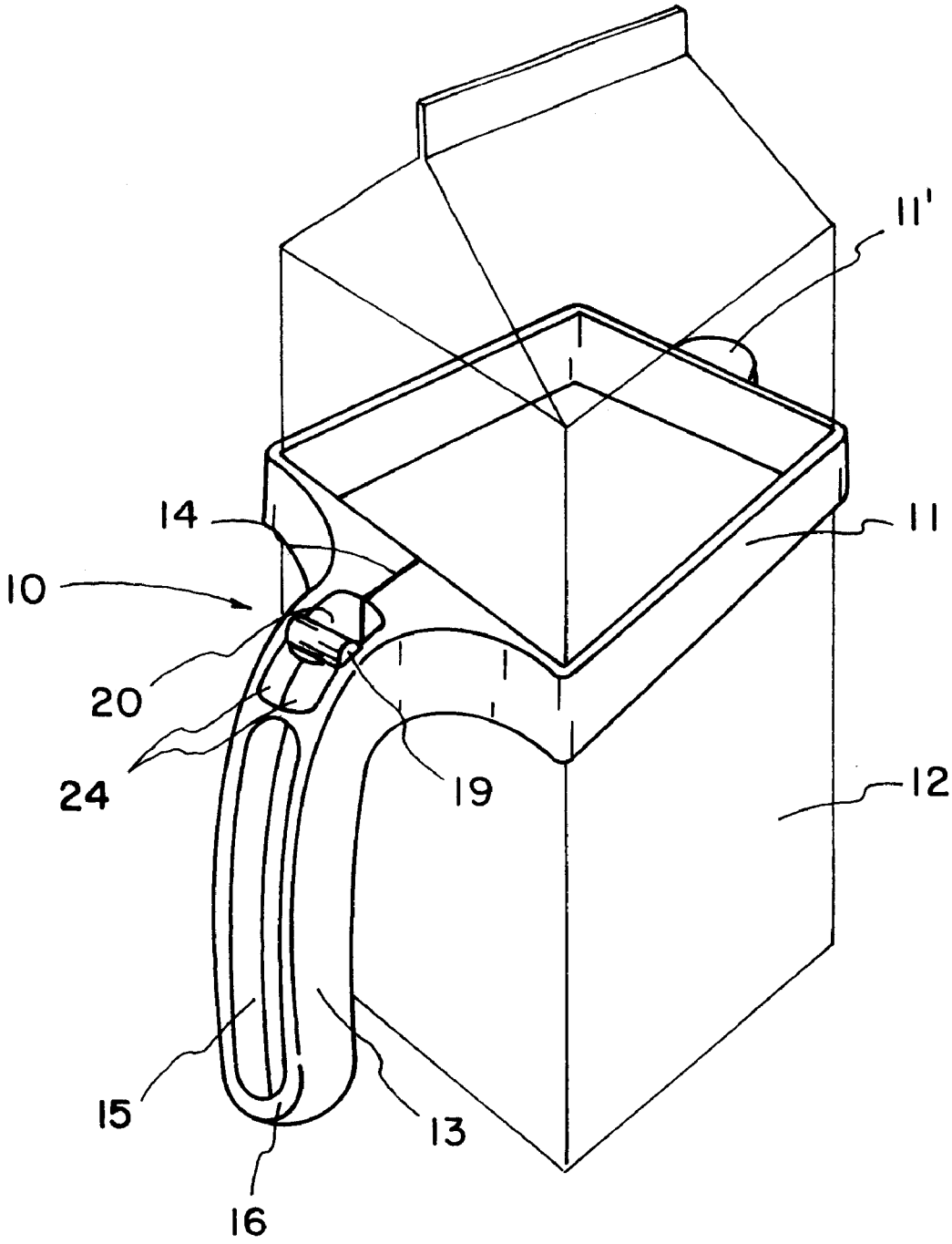
FIG. 2 is a perspective view of the handle of the present invention in the locked or carton gripping position ready to lift and pour.
Figure 3:
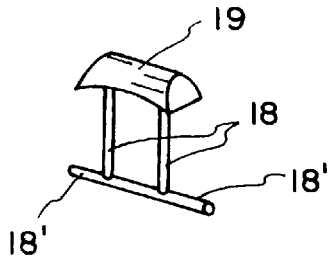
FIG. 3 is a perspective view of the toggle mechanism used in locking and unlocking the carton handle.
Figure 4:
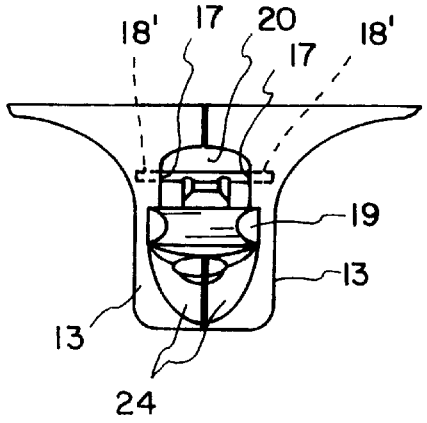
FIG. 4 is a top plan view with the toggle in the closed or locked position.

When the outer ends 18' of toggle arms 18 are inserted into the openings 17 in the walls of slot 14 and the toggle pushed toward the carton, the bias of the lower portion 16 of the handle will cause the slot to be in an open position as clearly shown in FIG. 5. This gapping of slot 14 allows the bail portion 11 of the handle to be easily slipped over the carton 12. When the bail portion is in the desired location, the toggle is pulled back away from the carton, pivoting on the ends 18' of toggle arms 18 that are mounted in the slot wall openings 17. When the toggle arms 18 contact the bevel surfaces 22 as the toggle is moved, the slot 14 is pulled tightly together as shown in FIGS. 2 and 4 to cause the bail portion 11 to grip and hold the carton 12. When the toggle is moved to its position farthest from the carton, the toggle arms 18 will engage notches 23 to hold slot 14 closed. A thumb guard 14 is mounted on both sides of the slot 14 and lies adjacent the toggle 19 when in a locked position. This thumb guard prevents unintentional disengagement of the toggle arms from notches 23 when in use. There is a slight depression 25 in the middle of thumb guard 24 so that the toggle can be moved back toward the carton when desired to open the slot 14 to allow the bail portion 11 to open so that the handle can be readily removed from such carton.

From the above it can be seen that the present invention provides a simple and yet highly efficient carton handle that can be loosened so that the bail portion readily slides over the carton and can be tightened by simply moving the toggle from a position adjacent the carton 12 to a position adjacent the thumb guard 24.

The carton handle 10 of the present position can be positioned to balance the weight of the carton so that the same can be easily poured. The handle is readily installable and removable from the carton and yet firmly grips the same during use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended.

What is claimed is:

1. A carton holder for liquid cartons characterized by generally planar side walls and a rectangular transverse cross section, said carton holder comprising: a one-piece handle body including a generally rectangular bail portion and an outwardly projecting and downwardly depending handle, said bail portion having an interference fit in a normal position with respect to said side walls whereby said carton may be telescopically slidably disposed with respect thereto, said bail portion having juxtaposed ends connected to an inner end of said handle, a vertically extending slot formed in said inner end of said handle between said juxtaposed ends of said bail portion and transverse to one side wall of said container; actuator means carried by said handle and coacting with said inner end of said handle adjacent said slot and effective for increasing the spacing between said juxtaposed ends of said bail portion sufficiently to establish a telescopic sliding fit between said bail member and said side walls of said carton as a result of movement of said actuator means between said normal position and a second position.

2. The carton handle as recited in claim 1 including detent mean s interacting between said inner ends of said handle body and said actuator means for maintaining said actuator means at said normal and said second position.

3. The carton handle as recited in claim 2 including a recess formed in the top surface of said inner ends adjacent said slot, said actuator means being disposed in said recess and coacting with surfaces of said recess for increasing said spacing between said juxtaposed ends of said bail portion as a result of movement toward said second position.

4. The carton handle as recited in claim 3 wherein said actuator means is pivotally connected to said handle body about an axis transverse to said slot.

5. The carton handle as recited in claim 3 wherein the outer end of said handle body projects down wardly in spaced relation to said side walls of said carton.

6. The carton handle as recited in claim 3 wherein said detent means are transverse projections formed adjacent a transition between surfaces defining said recess and said slot.

7. The carton handle as recited in claim 1 wherein said bail portion has planar surfaces for engagement with said side walls of said carton.

* * * * *